US008896502B2

(12) United States Patent
Toyomura et al.

(10) Patent No.: US 8,896,502 B2
(45) Date of Patent: Nov. 25, 2014

(54) DISPLAY DEVICE AND METHOD FOR DRIVING THE SAME

(75) Inventors: Naobumi Toyomura, Kanagawa (JP); Katsuhide Uchino, Kanagawa (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 1661 days.

(21) Appl. No.: 12/149,867

(22) Filed: May 9, 2008

(65) Prior Publication Data

US 2009/0002354 A1 Jan. 1, 2009

(30) Foreign Application Priority Data

Jun. 28, 2007 (JP) ..... 2007-170057

(51) Int. Cl.
*G09G 3/30* (2006.01)
*G09G 3/32* (2006.01)

(52) U.S. Cl.
CPC ..... *G09G 3/3291* (2013.01); *G09G 2320/0223* (2013.01); *G09G 2300/0842* (2013.01); *G09G 3/3233* (2013.01)
USPC ..... 345/76

(58) Field of Classification Search
CPC ..... G09G 3/3291
USPC ..... 345/76–82
See application file for complete search history.

(56) References Cited

U.S. PATENT DOCUMENTS

2003/0173588 A1* 9/2003 Bianchi ..... 257/200
2005/0162362 A1* 7/2005 Takasugi et al. ..... 345/90

FOREIGN PATENT DOCUMENTS

JP 2003-043995 A 2/2003
JP 2003-271095 A 9/2003
JP 2004-354428 A 12/2004
JP 2006-221172 A 8/2006
JP 2006-227237 8/2006
JP 2007-156460 A 6/2007
JP 2009-069552 A 4/2009

OTHER PUBLICATIONS

Japanese Office Action issued Mar. 21, 2012 in corresponding Japanese Application No. 2007-170057.

* cited by examiner

*Primary Examiner* — Dennis Joseph
(74) *Attorney, Agent, or Firm* — Rader, Fishman & Grauer PLLC

(57) ABSTRACT

A display device includes a display unit, a horizontal drive circuit, and a vertical drive circuit, the display unit including pixels in a matrix formation, as well as respective signal lines and scan lines via which the drive circuits drive the pixels. Each pixel includes a light-emitting element, a hold capacitor, a write transistor, and a drive transistor. Mobility fluctuations in the drive transistor are compensated for by successively setting the voltage of the signal line to an intermediate voltage and to a tone voltage. In addition, the intermediate voltage is varied in accordance with the tone voltage as well as with the distance from the input terminal of a write signal to a respective pixel. The device thereby compensates for mobility fluctuations in the drive transistor and prevents shading due to irregularities in the waveform of the write signal.

3 Claims, 10 Drawing Sheets

FIG. 5 --Related Art--

FIG. 6 --Related Art--

--Related Art--

--Related Art--

--Related Art--

--Related Art--

--Related Art--

--Related Art--

DISPLAY DEVICE AND METHOD FOR DRIVING THE SAME

CROSS REFERENCES TO RELATED APPLICATIONS

The present invention contains subject matter related to Japanese Patent Application JP 2007-170057 filed in the Japanese Patent Office on Jun. 28, 2007, the entire contents of which are incorporated herein by reference.

BACKGROUND OF THE INVENTION

1. Field of the Invention

The present invention relates to a display device and a method for driving a display device, and is applicable to active matrix display devices made up of organic electroluminescent (OEL) elements. More particularly, the present invention compensates for fluctuations in the mobility of a drive transistor by successively setting the voltage of a signal line to an intermediate voltage and to a tone voltage. Moreover, this intermediate voltage is varied in accordance with both the tone voltage as well as the distance from the input terminal of the write signal to a respective pixel. In so doing, fluctuations in the mobility of the drive transistor are appropriately compensated for, and shading due to irregularities in the waveform of the write signal is prevented.

2. Description of the Related Art

In the active matrix display devices utilizing OEL elements of the related art, a display unit is formed by disposing pixels in a matrix formation, each pixel including an OEL element and a drive circuit that drives the OEL element. The operation of each pixel is controlled by horizontal and vertical drive circuits disposed in the vicinity of the display unit, and thereby a desired image is displayed.

Japanese Unexamined Patent Application Publication No. JP 2006-227237 proposes technology related to OEL-based display devices, wherein a tone is set for each pixel to compensate for fluctuations in the threshold voltage of the drive transistor that drives the OEL elements. In so doing, reduced image quality due to fluctuations in the threshold voltage is prevented and high image quality is ensured, even in the case where an N-channel transistor is used.

However, there is a disadvantage in that the drive transistor adopted in these types of display devices exhibits fluctuations not only in the threshold voltage, but also in mobility. Thus these types of display devices are problematic in that image quality is also reduced as a result of fluctuations in the mobility of the drive transistor.

One method of resolving this problem has been devised wherein the circuit for each pixel is configured as shown in FIG. 5. In the display device 1 shown in FIG. 5 herein, a display unit is formed by disposing a plurality of pixels 3 in a matrix formation. In each pixel 3, one terminal of a hold capacitor C1 for retaining the signal level is connected to the anode of an OEL element 4, while the other terminal of the signal level hold capacitor C1 is connected to a signal line SIG via an interposed write transistor TR1 that switches on/off according to a write signal WS. In each pixel 3, both terminals of the signal level hold capacitor C1 are connected to the source and gate of a drive transistor TR2, the drain of this drive transistor TR2 being connected to a scan line SCN that supplies power. In FIG. 5, Vcath is the cathode voltage of the OEL element 4, while Csub is an auxiliary capacitor disposed parallel to the OEL element 4.

In the display device 1, a write signal WS and a drive signal DS for supplying power are output to the scan line SCN by a write scan circuit (WSCN) 5A and a drive scan circuit (DSCN) 5B, respectively. In addition, a drive signal Ssig is output to the signal line SIG by the horizontal selector (HSEL) 6A of a horizontal drive circuit 6. The operation of the pixel 3 is controlled by the above.

FIG. 6 is a timing chart showing the operation of the pixel 3. The write transistor TR1 is switched on by raising the write signal WS (line (A) in FIG. 6) for a predetermined timing during a non-emitting period wherein light emission from the pixel 3 is suspended. In addition, during this non-emitting period of the pixel 3, the drive signal DS for supplying power (line (B) in FIG. 6) is lowered from a power supply voltage Vcc to a predetermined, fixed voltage Vini for a predetermined period starting from the commencement of the non-emitting period. In addition, the drive signal Ssig (line (C) in FIG. 6) is repeatedly alternated between the tone voltage Vsig of each pixel connected to the signal line SIG and a predetermined, fixed voltage Vofs. The tone voltage Vsig referred to herein is a voltage that indicates the luminance of the OEL element 4 provided in each pixel 3.

During the emitting period of the pixel 3 (i.e., the period wherein the OEL element 4 is made to emit light), the write transistor TR1 is switched off by the write signal WS, and the power supply voltage Vcc is supplied to the drive transistor TR2 by the drive signal DS. In so doing, the gate voltage Vg and the source voltage Vs of the drive transistor TR2 (lines (D) and (E) in FIG. 6) are stored on either terminal of the signal level hold capacitor C1. The OEL element 4 is then driven by the driving current Ids that arises due to the differential voltage between the terminals of the signal level hold capacitor C1. This driving current Ids is expressed by the equation below. The quantity Vgs referred to herein is the voltage between the gate and the source of the drive transistor TR2, and is equivalent to the differential voltage between the two terminals of the signal level hold capacitor C1. In addition, the quantity μ herein is the mobility, W is the channel width, L is the channel length, Cox is the capacitance of the gate insulator per unit area, and Vth is the threshold voltage, all with respect to the transistor TR2.

Equation 1

$$I_{ds} = \frac{1}{2}\mu\frac{W}{L}C_{ox}(V_{gs} - V_{th})^2 \quad (1)$$

When the emitting period of the pixel 3 ends at a time t1, the drain voltage of the transistor TR2 is lowered to the predetermined voltage Vini by the drive signal DS for supplying power. The voltage Vini referred to herein is a voltage sufficiently low to cause the drain of the drive transistor TR2 to function as the source. This causes the accumulated charge at the terminal of the hold capacitor C1 on the side of the OEL element 4 to be discharged and carried to the scan line SCN via the drive transistor TR2. The source voltage Vs of the drive transistor TR2 is thereby lowered to the voltage Vini, and emission from the OEL element 4 in the pixel 3 ceases.

Subsequently, the voltage of the signal line SIG is lowered to a predetermined, fixed voltage Vofs by the drive signal Ssig at a time t2, and the write transistor TR1 is switched on by the write signal WS (lines (A) and (C) in FIG. 6). In so doing, the gate voltage Vg of the drive transistor TR2 in the pixel 3 is set to the voltage Vofs of the signal line SIG, and thus the voltage Vgs between the gate and the source of the drive transistor TR2 becomes Vofs-Vini. By thus setting the fixed voltages Vofs and Vini in the pixel 3, the expression Vofs-Vini yields a voltage that is larger than the threshold voltage Vth of the drive transistor TR2.

Subsequently, the drain voltage of the drive transistor TR2 in the pixel 3 is raised to the power supply voltage Vcc by the drive signal DS for supplying power at a time t3 (lines (A) to (C) in FIG. 6). This causes a charging current to flow from the power supply voltage Vcc to the terminal of the capacitor C1 on the side of the OEL element 4 via the drive transistor TR2, and as a result, the voltage Vs of the capacitor terminal on the side of the OEL element 4 gradually rises. While this also causes an influx of current to the OEL element 4 in the pixel 3, this influx of current is used to charge the capacitor of the OEL element 4 and the auxiliary capacitor Csub. Thus the OEL element 4 does not emit light at this point, and only the source voltage Vs of the drive transistor TR2 rises.

At a subsequent time t4, the write transistor TR1 of the pixel 3 is switched off by the write signal WS, and then the signal level of the signal line SIG is set to the tone voltage Vsig for the next corresponding pixel on the adjacent line. This causes the source voltage Vs of the drive transistor TR2 to gradually rise in accordance with the differential voltage between the terminals of the signal level hold capacitor at time t4. Moreover, the gate voltage Vg of the drive transistor TR2 also increases in conjunction with the increase in the source voltage Vs. Meanwhile, during this time the tone settings for the next corresponding pixel on the adjacent line are used to set the tone voltage Vsig of the signal line SIG.

After a fixed period of time has elapsed, the signal level of the signal line SIG is again switched to the voltage Vofs at a time t5, while additionally the write transistor TR1 is switched on by raising the write signal WS. When the differential voltage between the terminals of the signal level hold capacitor C1 in pixel 3 is greater than the threshold voltage of the drive transistor TR2, the above causes a charging current to flow from the power supply Vcc to the terminal of the signal level hold capacitor C1 on the side of the OEL element 4 via the drive transistor TR2, while at the same time maintaining the voltage Vofs at the signal level hold capacitor C1 on the side of the signal line SIG. As a result, the source voltage Vs of the drive transistor TR2 gradually rises. Moreover, when this increase in the source voltage Vs causes the voltage differential between the terminals of the signal level hold capacitor C1 to reach the threshold voltage Vth of the drive transistor TR2, the influx of charging current via the drive transistor TR2 ceases, and thus the increase in the source voltage Vs of the drive transistor TR2 also ceases.

After a fixed period of time has elapsed, the write transistor TR1 is switched off by the write signal WS at a time t6. In conducting this series of operations in the pixel 3, the period from the time t1 to the time t2 is assigned as the preliminary period for compensating for fluctuations in the threshold voltage Vth of the drive transistor TR2, wherein the voltage differential between the terminals of the signal level hold capacitor C1 is set to a voltage value that is larger than the threshold voltage Vth of the drive transistor TR2. In addition, the period from the time t3 to the time t4 as well as the period from the time t5 to the time t6 are assigned as the periods of compensation for the fluctuations in the threshold voltage Vth of the drive transistor TR2, wherein the voltage differential between the terminals of the signal level hold capacitor C1 is set to the threshold voltage Vth of the drive transistor TR2. Furthermore, three or more of these periods of compensation for fluctuations may be provided as necessary.

The signal level of the signal line SIG is then set to the tone voltage Vsig for the corresponding pixel 3. At a subsequent time t7, the write transistor TR1 is switched on by the write signal WS. This works to counteract the threshold voltage Vth of the transistor TR2 in the pixel 3, and thereby the signal level hold capacitor is set to the tone voltage Vsig. As a result, fluctuations in the luminance of the pixel 3 due to fluctuations in the threshold voltage Vth of the transistor TR2 are prevented.

In the pixel 3 herein, the write transistor TR1 is switched off by the write signal WS at a time t8, occurring after a fixed period of time Tμ passes after the write transistor TR1 is switched on at the time t7. The voltage Vsig of the signal line SIG is meanwhile held by the signal level hold capacitor C1. During this period Tμ, the terminal of the signal level hold capacitor C1 on the side of the OEL element 4 is charged by the driving current of the drive transistor TR2 in accordance with the differential voltage between the terminals of the signal level hold capacitor C1, and thereby the source voltage Vs of the transistor TR1 rises. As indicated in Equation 1, the driving current referred to herein is proportional to the mobility μ, and thus the rate of increase in the source voltage Vs changes during the period Tμ in accordance with the mobility μ of the drive transistor TR2. The differential voltage between the terminals of the signal level hold capacitor C1 is compensated for in the direction of decreasing luminance to the degree that the mobility μ is large. As a result, mobility fluctuation in the drive transistor TR2 of the pixel 3 is compensated for during the period Tμ, while the OEL element 4 is later made to emit light via a bootstrap method, using a driving current in accordance with the differential voltage between the terminals of the signal level hold capacitor C1.

As a result of the configuration in FIG. 5, a pixel circuit is formed using an N-channel transistor, wherein reduced image quality due to fluctuations in the threshold voltage and mobility of the drive transistor TR2 is prevented using a simple circuit configuration.

However, as a result of the configuration shown in FIG. 5, when compensating for fluctuations in the mobility of the drive transistor TR2 during the fixed period Tμ by simply using the tone voltage Vsig, there is a problem in that, fluctuations are over- or under-compensated for depending on the tone voltage Vsig, thereby reducing the image quality.

More specifically, with the configuration in FIG. 5 the following occurs, as illustrated in FIG. 7. When displaying white tones, a relatively high voltage value for the tone voltage Vsig is held compared to that in the case of displaying gray tones. In this case, the rate of increase in the source voltage Vs is higher than that in the case of displaying gray tones. As a result, in this case, fluctuations in the mobility of the drive transistor TR2 are compensated for in a short period of time, as indicated by the period TW. FIG. 7 shows the change in the source voltage Vs for both high-mobility and low-mobility cases, as indicated by lines L3 and L4, respectively.

In contrast, when displaying gray tones, a relatively low voltage value for the tone voltage Vsig is held compared to that in the case of displaying white tones, and thus the rate of increase in the source voltage Vs is lower than that in the case of displaying white tones. As a result, the time period required to compensate for mobility fluctuations in the drive transistor TR2 becomes longer, as indicated by the period TG.

A method for resolving this problem has been devised, wherein during the period Tμ for compensating for mobility fluctuations, the signal level of the signal line SIG is switched from the fixed voltage Vofs to the tone voltage Vsig, with a predetermined intermediate voltage Vofs2 therebetween. This method is shown in FIGS. 8 and 10. Herein, FIG. 8 shows the case wherein a tone voltage Vsig(W) for a white tone is applied, while FIG. 10 shows the case wherein a tone voltage Vsig(B) for a black tone is applied.

When displaying a white tone in this manner, the amount of time T1 required to compensate for mobility fluctuations in the drive transistor TR2 is longer than that of the example in FIG. 5, as indicated by the arrow in FIG. 9. The broken line in FIG. 9 shows the change in the source voltage Vs of the drive transistor TR2 as a result of the configuration in FIG. 5.

In addition, when displaying gray tones, the amount of time T2 required to compensate for mobility fluctuations in the drive transistor TR2 can be reduced to a value smaller than that of the example in FIG. 5, as indicated by the arrow in FIG. 11. The broken line in FIG. 11 shows the change in the source voltage Vs as a result of the configuration in FIG. 5.

Compensating for mobility fluctuations as above by raising the signal level of the signal line SIG from the fixed voltage Vofs to the tone voltage Vsig with a predetermined intermediate voltage Vofs2 therebetween enables mobility fluctuations to be appropriately compensated for by setting this intermediate voltage Vofs2, even in cases wherein there is a variety of different luminance levels. When compensating for mobility via an intermediate voltage Vofs2 in this manner, however, it is necessary to extend the mobility compensation period Tμ so as to be longer than that of the configuration shown in FIG. 5.

However, waveform irregularity of the write signal WS becomes smallest near the input terminal of the scan line SCN in the display unit 2 (as shown in area A in FIG. 12), while waveform irregularity becomes larger as the signal becomes more distant from the input terminal (as shown in area B). As a result, the timing by which the write transistor TR1 is switched on/off varies as the write signal WS grows more distant from the input terminal. Moreover, the period Tμ2, during which mobility is compensated for by using the intermediate voltage Vofs2, becomes shorter with increasing distance from the input terminal. This causes shading to occur in the horizontal direction of the screen.

SUMMARY OF THE INVENTION

The present invention, being devised in the light of the above issues, proposes a display device and a method for driving a display device wherein fluctuations in the mobility of the drive transistor are suitably compensated for and shading due to irregularities in the waveform of the write signal is prevented.

According to a first embodiment of the present invention, there is provided a display device that displays a desired image using a display unit. The display unit is formed by disposing a plurality of pixels in a matrix formation, and an image is formed by driving each pixel using a horizontal drive circuit and a vertical drive circuit via a signal line and a scan line provided in the display unit. Each pixel includes: a light-emitting element; a hold capacitor for retaining the signal level; a write transistor that connects one terminal of the signal level hold capacitor to the signal line, being switched on by a write signal output from the vertical drive circuit; and a drive transistor that drives the light-emitting element using a driving current in accordance with the differential voltage between the terminals of the signal level hold capacitor. During a non-emitting period during which the emission of light from the light-emitting element is suspended, the horizontal drive circuit switches the voltage of the signal line in succession from a fixed voltage, to an intermediate voltage, and to a tone voltage that corresponds to the luminance of the light-emitting element. The vertical drive circuit controls the write signal as well as the power source of the drive transistor in order to set the differential voltage between the terminals of the signal level hold capacitor to a pre-mobility compensation voltage, this voltage being the threshold voltage of the drive transistor. Subsequently, during the period wherein the voltage of the signal line is being set to the intermediate voltage and the tone voltage, the vertical drive circuit controls the write signal in order to compensate for the mobility of the drive transistor and set the differential voltage between the terminals of the signal level hold capacitor to a voltage corresponding to the tone voltage. The horizontal drive circuit also varies the intermediate voltage in accordance with changes in the tone voltage as well as in accordance with the distance from the input terminal of the write signal to a respective pixel in the display unit, such that the change in the intermediate voltage is expressible by a second-order function.

According to another embodiment of the present invention, there is provided a method for driving a display device, the device displaying a desired image using a display unit. The display unit is formed by disposing a plurality of pixels in a matrix formation, and an image is formed by driving each pixel via a signal line and a scan line provided in the display unit. Each pixel includes: a light-emitting element; a hold capacitor for retaining the signal level; a write transistor that connects one terminal of the signal level hold capacitor to the signal line, being switched on by a write signal output via the signal line; and a drive transistor that drives the light-emitting element using a driving current in accordance with the voltage between the terminals of the signal level hold capacitor. The driving method involves the following. During a non-emitting period during which the emission of light from the light-emitting element is suspended, the voltage of the signal line is switched in succession from a fixed voltage, to an intermediate voltage, and to a tone voltage that indicates the luminance of the light-emitting element. The write signal as well as the power source of the drive transistor are then controlled in order to set the differential voltage between the terminals of the signal level hold capacitor to a pre-mobility compensation voltage, this voltage being the threshold voltage of the drive transistor. Subsequently, during the period wherein the voltage of the signal line is being set to the intermediate voltage and the tone voltage, the write signal is controlled in order to compensate for the mobility of the drive transistor and set the differential voltage between the terminals of the signal level hold capacitor to a voltage corresponding to the tone voltage. The intermediate voltage is also varied in accordance with changes in the tone voltage as well as in accordance with the distance from the input terminal of the write signal to a respective pixel in the display unit, such that the change in the intermediate voltage is expressible by a second-order function.

As a result of the configurations in accordance with either of the above embodiments of the invention, varying the intermediate voltage in accordance with the tone voltage enables prevention of over- or under-compensation due to differences in tone voltages when compensating for mobility fluctuations in the drive transistor by successively setting the voltage of the signal line to an intermediate voltage and to a tone voltage. In addition, the intermediate voltage is varied in accordance with the distance from the input terminal of the write signal to a respective pixel of the display unit. In so doing, changes in the time period required for compensating for the operational timing of the write transistor are themselves compensated for, even in cases wherein such timing changes are due to waveform irregularities in the write signal as a result of this distance. As a result, shading due to waveform irregularities in the write signal is prevented.

As a result of the present invention, fluctuations in the mobility of the drive transistor are suitably compensated for and shading due to waveform irregularities in the write signal is prevented, and thus in-panel uniformity is improved.

DESCRIPTION OF THE PREFERRED EMBODIMENTS

Hereinafter, embodiments of the invention will be described in detail and with reference to the accompanying drawings.

First Embodiment (1) Structure of the Embodiment

Figure 2:
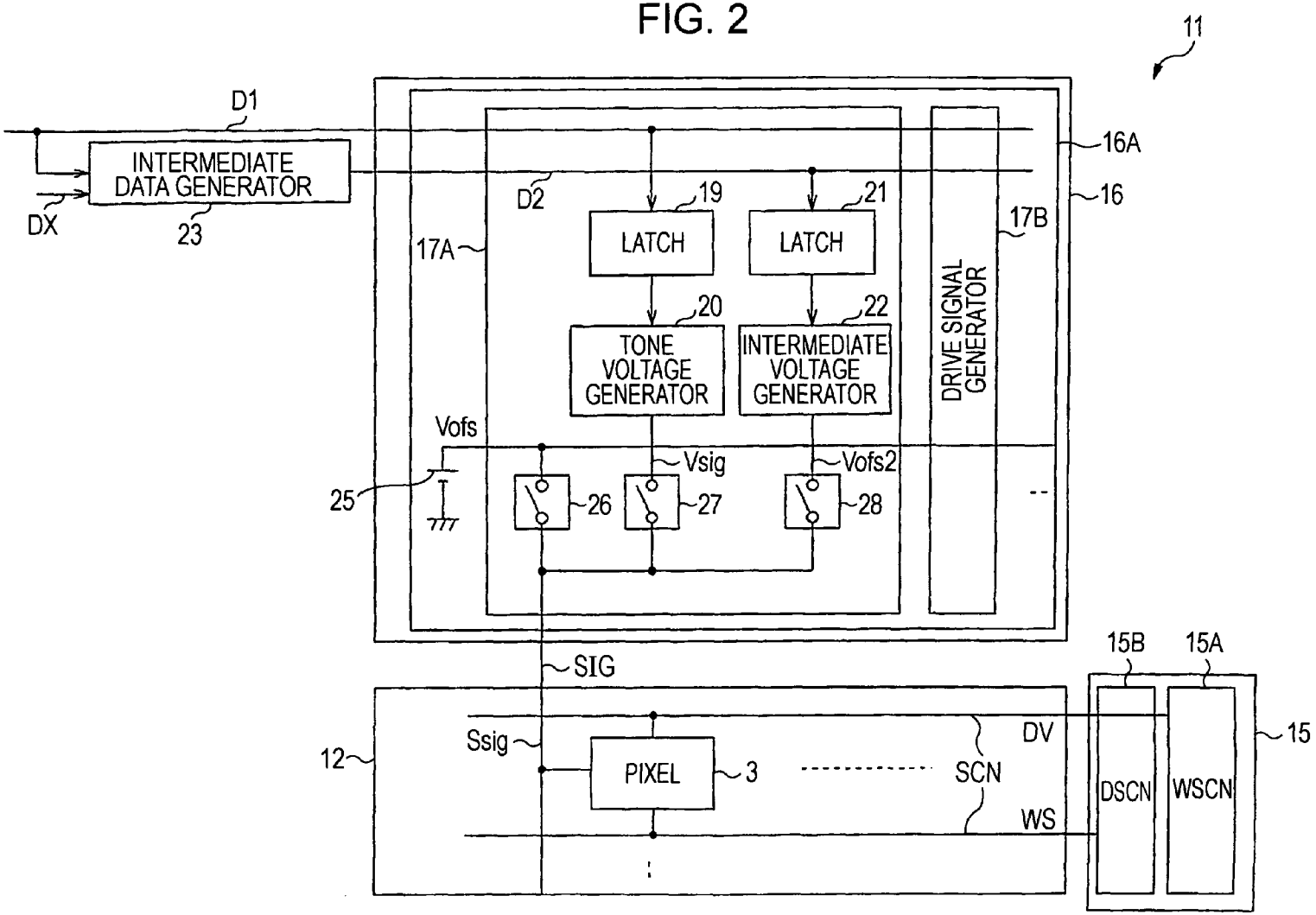
FIG. 2 is a block diagram of a display device according to a first embodiment of the present invention.

FIG. 2 is a block diagram showing a display device in accordance with a first embodiment of the present invention. This display device 11 is provided with a vertical drive circuit 15 and a horizontal drive circuit 16 in the vicinity of a display unit 12, being disposed upon an insulating substrate that constitutes the display unit 12. By driving the display unit 12 via the vertical drive circuit 15 and the horizontal drive circuit 16, the voltage of the signal line in the display device 11 is successively set to an intermediate voltage and to a tone voltage, thereby compensating for fluctuations in the mobility of the drive transistor. This is similar to that described above with reference to FIGS. 7 to 10.

The configuration of the display unit 12 herein is identical to that of the display unit 2 described above with reference to FIG. 4. A horizontal selector (HSEL) 16A of the horizontal drive circuit 16 outputs a drive signal Ssig to a respective signal line SIG, the signal being a repeated cycle of a fixed voltage Vofs, an intermediate voltage Vofs2, and a tone voltage Vsig. For this reason, the horizontal selector 16A is provided with separate drive signal generator circuits 17A, 17B, etc., for each signal line SIG of the display unit 12, and generates a drive signal Ssig for each respective signal line SIG using the respective drive signal generator circuit 17A, 17B, etc., corresponding thereto.

More specifically, the horizontal selector 16A forwards a predetermined latch pulse to the drive signal generator circuits 17A, 17B, etc., in succession. As a result of this latch pulse, the respective drive signal generator circuits 17A, 17B, etc., trap image data D1 in a latch circuit 19. In this way, the horizontal selector 16A allocates to a corresponding signal line SIG image data D1, this data being data to be input in a raster scanning sequence, for example.

A tone voltage generator circuit 20 selectively outputs a reference voltage corresponding to the image data D1 trapped in the latch circuit 19, the reference voltage being selected from a plurality of reference voltages output from a reference voltage generator circuit (not shown) provided in the horizontal selector 16A. In so doing, this image data D1 undergoes analog to digital conversion, thereby generating a tone voltage Vsig. In this way, the tone voltage generator circuit 20 outputs a tone voltage Vsig for a respective pixel 3 connected to a corresponding signal line SIG, the time division of the output having units of one horizontal scan period, for example.

Similarly to the latch circuit 19, a latch circuit 21 receives a successively forwarded latch pulse, and as a result traps and outputs intermediate data D2, this data being data for the intermediate voltage Vofs2 and output from an intermediate data generator circuit 23.

Similarly to the tone voltage generator circuit 20, an intermediate voltage generator circuit 22 performs analog to digital conversion on the intermediate data D2 that was trapped in the latch circuit 21, thereby generating an intermediate voltage Vofs2. Similarly to the tone voltage generator circuit 20, in this way the intermediate voltage generator circuit 22 outputs an intermediate voltage Vofs2 for a respective pixel 3 connected to a corresponding signal line SIG, the time division of the output having units of one horizontal scan period, for example.

A power circuit 25 outputs a fixed voltage Vofs, this voltage being lower than the tone voltage Vsig for a black tone. Switch circuits 26, 27, and 28 selectively output the fixed voltage Vofs, the tone voltage Vsig, and the intermediate voltage Vofs2 to a corresponding signal line SIG. The display device 11 sets the respective pixels 3 of the display unit 12 to tone voltages Vsig in succession on a per-line basis. In order to do so, the switch circuits 26, 27, and 28 are set to a repeated cycle over a single horizontal scan as shown by line (C) in FIG. 3, wherein drive signals Ssig are output to respective signal lines SIG, the signals being a cyclical repetition of the fixed voltage Vofs, the intermediate voltage Vosf2, and the tone voltage Vsig, in that order.

The vertical drive circuit 15 generates a write signal WS and a drive signal DS using a write scan circuit (WSCN) 15A and a drive scan circuit (DSCN) 15B. The vertical drive circuit 15 then inputs this write signal WS and drive signal DS into a scan line SCN of the display unit 12.

As a result, periods of intermediate voltage Vofs2 are provided in the display device 11 both during the preparatory pre-compensation period for the threshold voltage, as well as during the respective horizontal scan periods of the threshold voltage compensation period. Thus, in order to compensate for the threshold voltage Vth during the non-emitting period, the write scan circuit 15A raises the voltage level of the write signal WS (as shown by line (A) in FIG. 3) to switch on the write transistor TR1 during the periods Tth1, Tth2, and Tth3, during which the voltage of level of the drive signal Ssig of the signal line SIG is lowered to the fixed voltage Vofs. In addition, during the mobility fluctuation compensation period Tμ, the write scan circuit 15A raises the voltage level of the write signal WS to switch on the write transistor TR1 for a fixed period, during which the drive signal Ssig of the signal line SIG is switched from the intermediate voltage Vofs2 to the tone voltage Vsig. Correspondingly, the drive scan circuit 15B lowers the drive signal DS (as shown by line (B) in FIG. 3) to suspend the operation of the drive transistor TR2 for a fixed period starting from the commencement of the non-emitting period and during which the drive signal Ssig of the signal line SIG is switched from the tone voltage Vsig to the fixed voltage Vofs, thus forming a preparatory period for compensating for the threshold voltage Vth.

Figure 3:
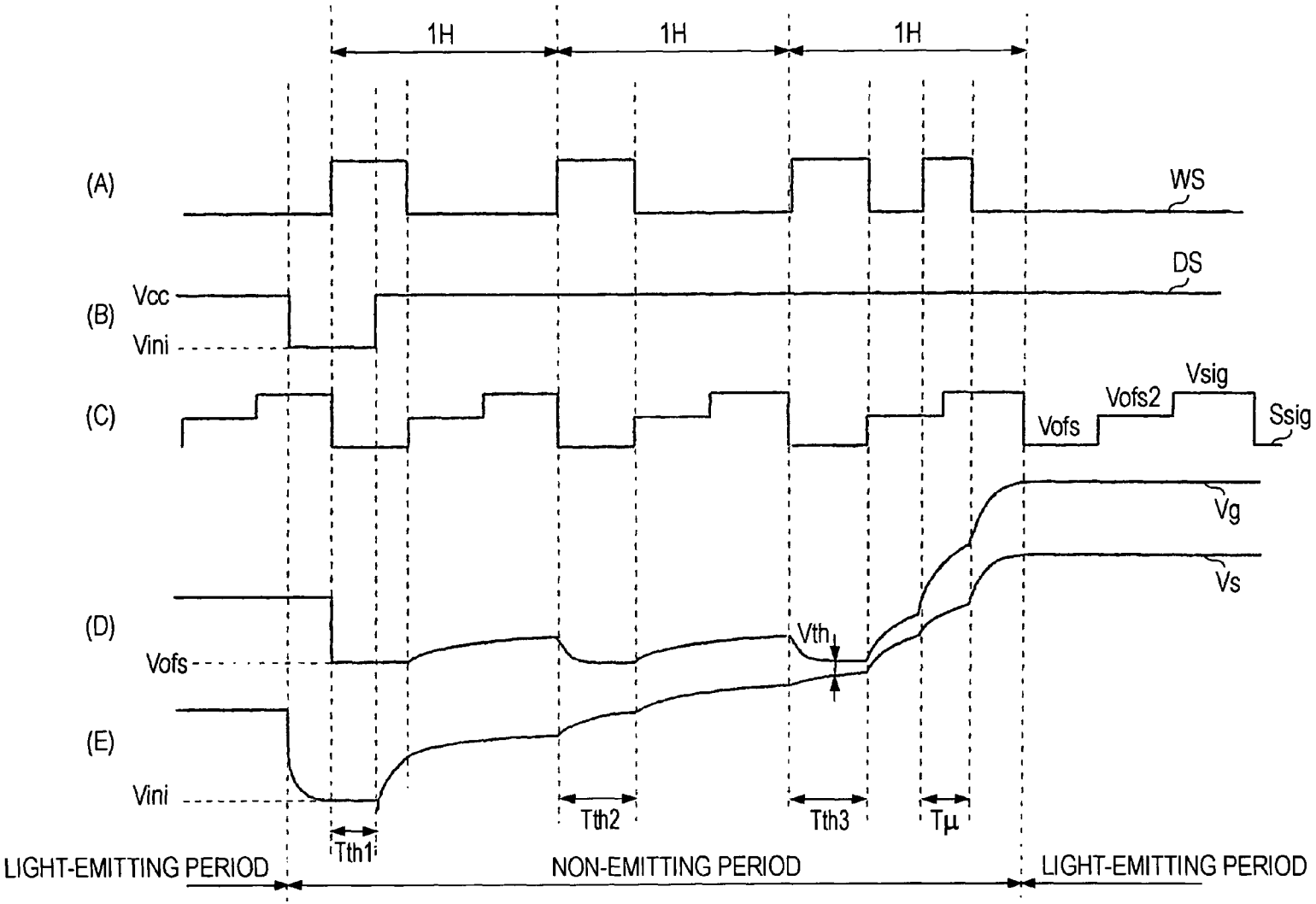
FIG. 3 is a timing chart for explaining the operation of display device in FIG. 2.

Although in FIG. 3 the threshold voltage Vth is shown to be compensated for three times during the three periods Tth1, Tth2, and Tth3, the number of times the threshold voltage Vth is compensated for may be four or more, as necessary. Moreover, this number may also be two times or less when sufficient practical characteristics can be ensured thereby.

As a result of the above, the voltage of the signal line SIG in the display device 11 is cyclically switched in succession from a fixed voltage Vofs, to an intermediate voltage Vofs2, and to a tone voltage Vsig during the non-emitting period, during which light emission from the OEL elements 4 (i.e., the light-emitting elements) is suspended. When the non-emitting period commences, the write signal WS and the power of the drive transistor TR2 are controlled so as to compensate for the threshold voltage Vth, thereby setting the voltage differential between the terminals of the signal level hold capacitor C1 to the threshold voltage Vth of the drive transistor TR2, this voltage being a pre-mobility compensation voltage. Subsequently, the write signal WS is controlled for a period during which the voltage of the signal line SIG is switched from the intermediate voltage Vofs2 to the tone voltage Vsig, thereby compensating for the mobility μ of the drive transistor TR2 and setting the voltage differential between the terminals of the signal level hold capacitor C1 to a voltage that corresponds to the tone voltage Vsig.

Figure 4:
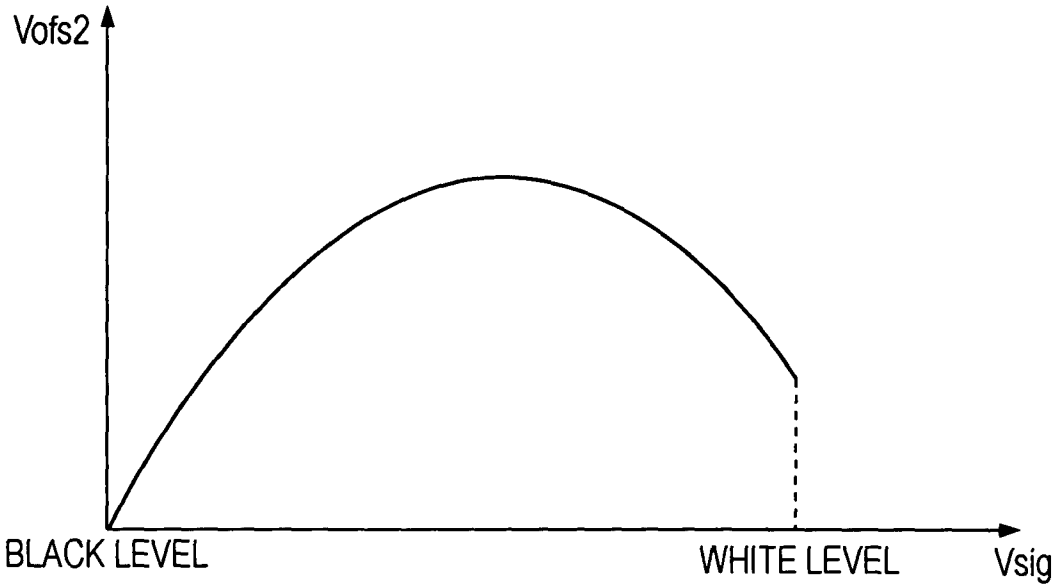
FIG. 4 is a plot of a characteristic curve illustrating the relationship between the tone voltage and the intermediate voltage in the display device in FIG. 2.

An intermediate data generator circuit 23 is structured for example as a lookup table, the circuit generating and outputting intermediate data D2 according to the image data D1 and distance data DX. FIG. 4 is a plot of a characteristic curve illustrating the relationship between the tone voltage Vsig, generated by performing analog to digital conversion on the image data D1, and the intermediated voltage Vofs2, generated by performing analog to digital conversion on the intermediate data D2. By using a lookup table, the intermediate data generator circuit 23 generates intermediate data D2 such that the intermediate voltage Vofs2 varies according to a second-order function and with respect to the tone voltage Vsig changing from a black level voltage to a white level voltage. In addition, the peak of the characteristic curve of this second-order function is set so as to be at the position of a tone voltage Vsig for a gray level residing between the white level voltage and the black level voltage. In so doing, the display device 11 compensates for fluctuations in the mobility μ of the drive transistor TR2 by successively setting the voltage of the signal line to an intermediate voltage and then a tone voltage, thereby compensating for mobility fluctuations and preventing over- and under-compensation of the mobility due to changes in the tone voltage Vsig.

Figure 1:
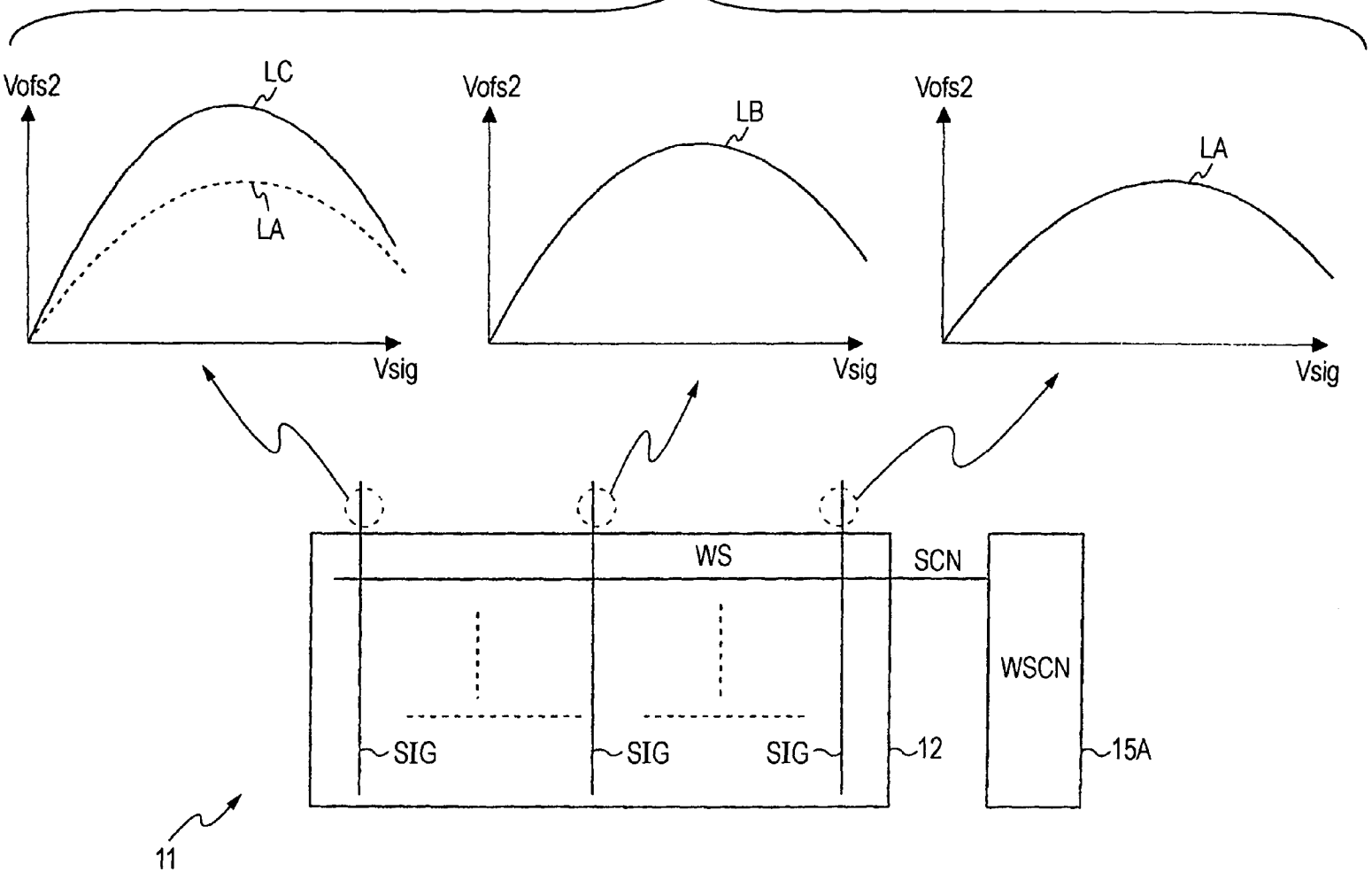
FIG. 1 is an abbreviated diagram of a circuit for explaining the intermediate voltage in a display device according to a first embodiment of the present invention.

Consequently, the intermediate data generator circuit 23 generates intermediate data D2 according to the distance data DX such that the characteristic peak voltage of the second-order function increases as the distance from the input terminal of the write signal WS of the display unit 12 to the respective pixels 3 increases, as shown in FIG. 1. The curves LA, LB, and LC shown in FIG. 1 are characteristic curves illustrating the characteristics of the intermediate voltage Vofs2 at the input terminal of the scan line SCN where the write signal WS is input, at the approximate midpoint of the scan line SCN, and at the end terminal, respectively.

(2) Operation of the Embodiment

Figure 5:
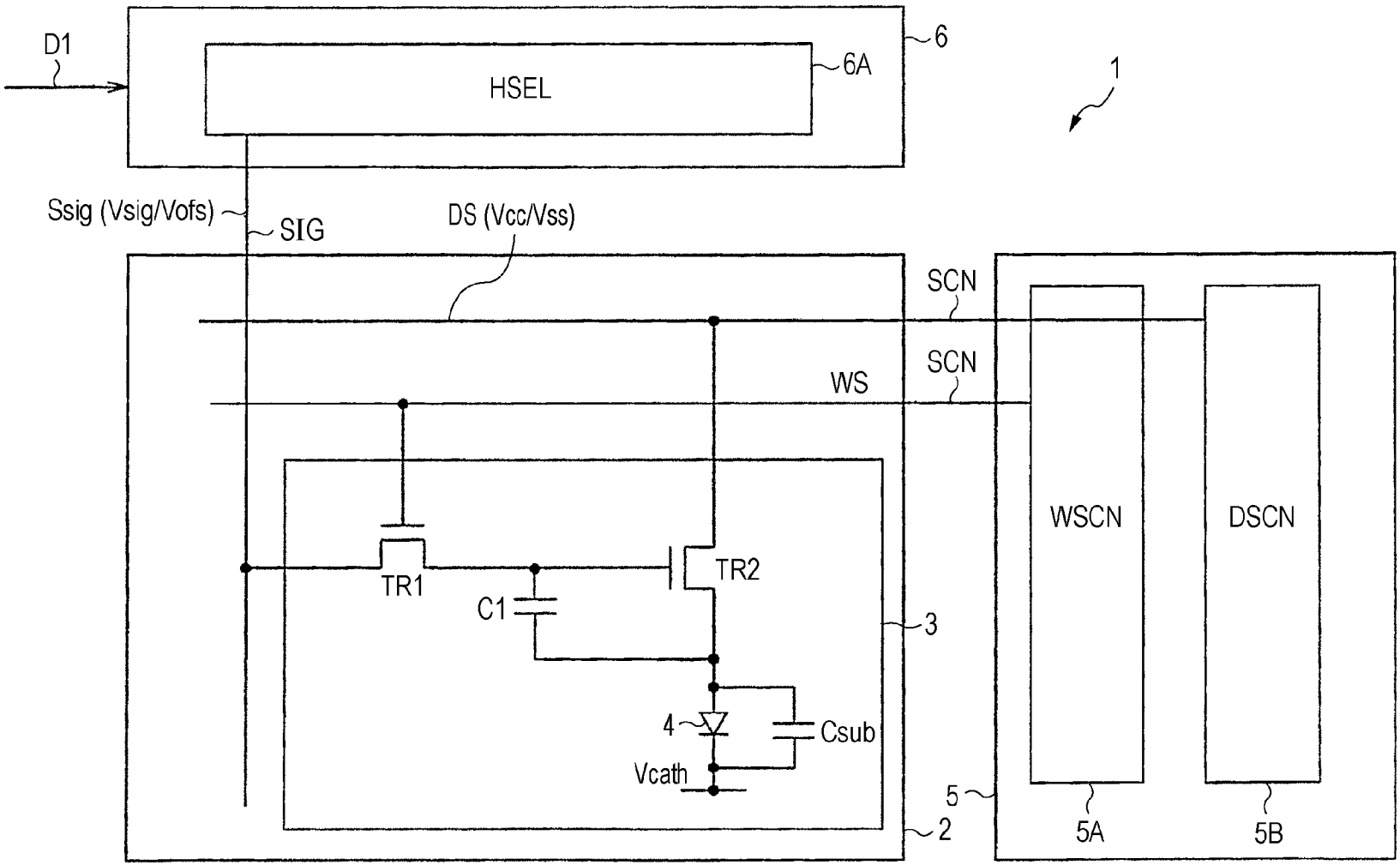
FIG. 5 is a block diagram of a display device devised using N-channel transistors.

In the display device 11 of the present embodiment having the foregoing configuration (cf. FIGS. 2 and 5), a display unit 12 is driven by a horizontal drive circuit 16 and a vertical drive circuit 15, whereby the pixels 3 of the display unit 12 are set to the tone voltage Vsig of the signal line in succession on a per-line basis. Moreover, as a result of the tone voltage Vsig set thereby, the OEL elements 4 of the respective pixels 3 emit light, and thereby a desired image is displayed on the display unit 12.

More specifically, the following occurs in the present display device. During the non-emitting period, one terminal of the signal level hold capacitor C1 is set to the tone voltage Vsig of the signal line SIG, and during the emitting period, the OEL elements 4 are driven by the differential voltage Vgs between the gate and the source of the transistor TR2, this voltage being due to the differential voltage between the terminals of the signal level hold capacitor C1. As a result, the OEL elements 4 of the respective pixels 3 in the present display device emit light, the luminance thereof varying according to the tone voltage Vsig of the signal line SIG.

The display device 11 first sets the tone voltage Vsig in advance (cf. FIG. 3). When the non-emitting period commences, first the voltages of both terminals of the signal level hold capacitor are set to a predetermined fixed voltage Vofs and Vini, and subsequently discharged via the transistor TR2 that drives the OEL element 4. In so doing, the signal level hold capacitor C1 is set to the threshold voltage Vth of the transistor TR2 (cf. periods Tth1, Tth2, and Tth3 in FIG. 3). As a result, fluctuations in the luminance of the display device 11 due to fluctuations in the threshold voltage Vth of the transistor TR2 are compensated for.

Figure 6:
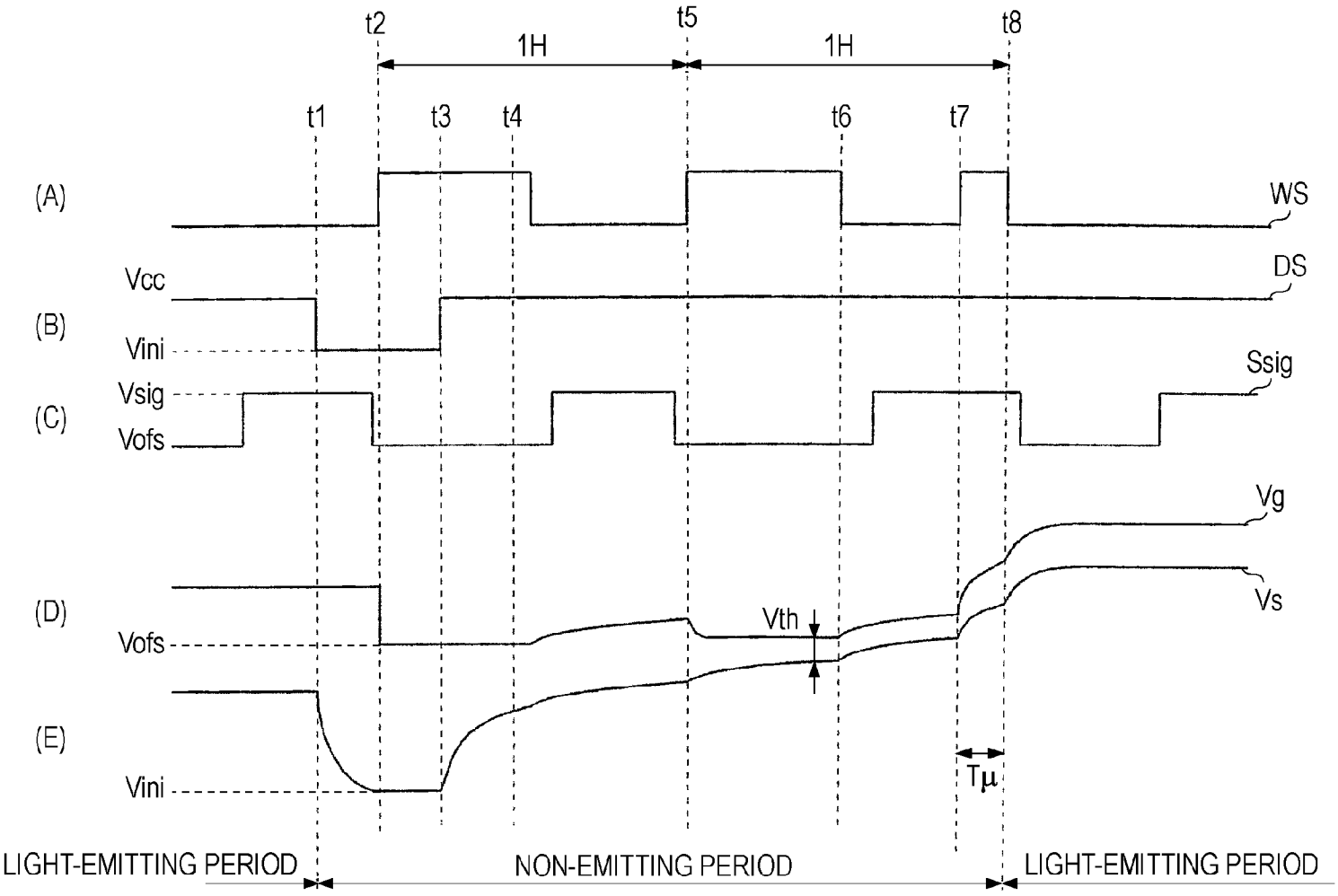
FIG. 6 is a timing chart for explaining the operation of the display device in FIG. 5.
Figure 7:
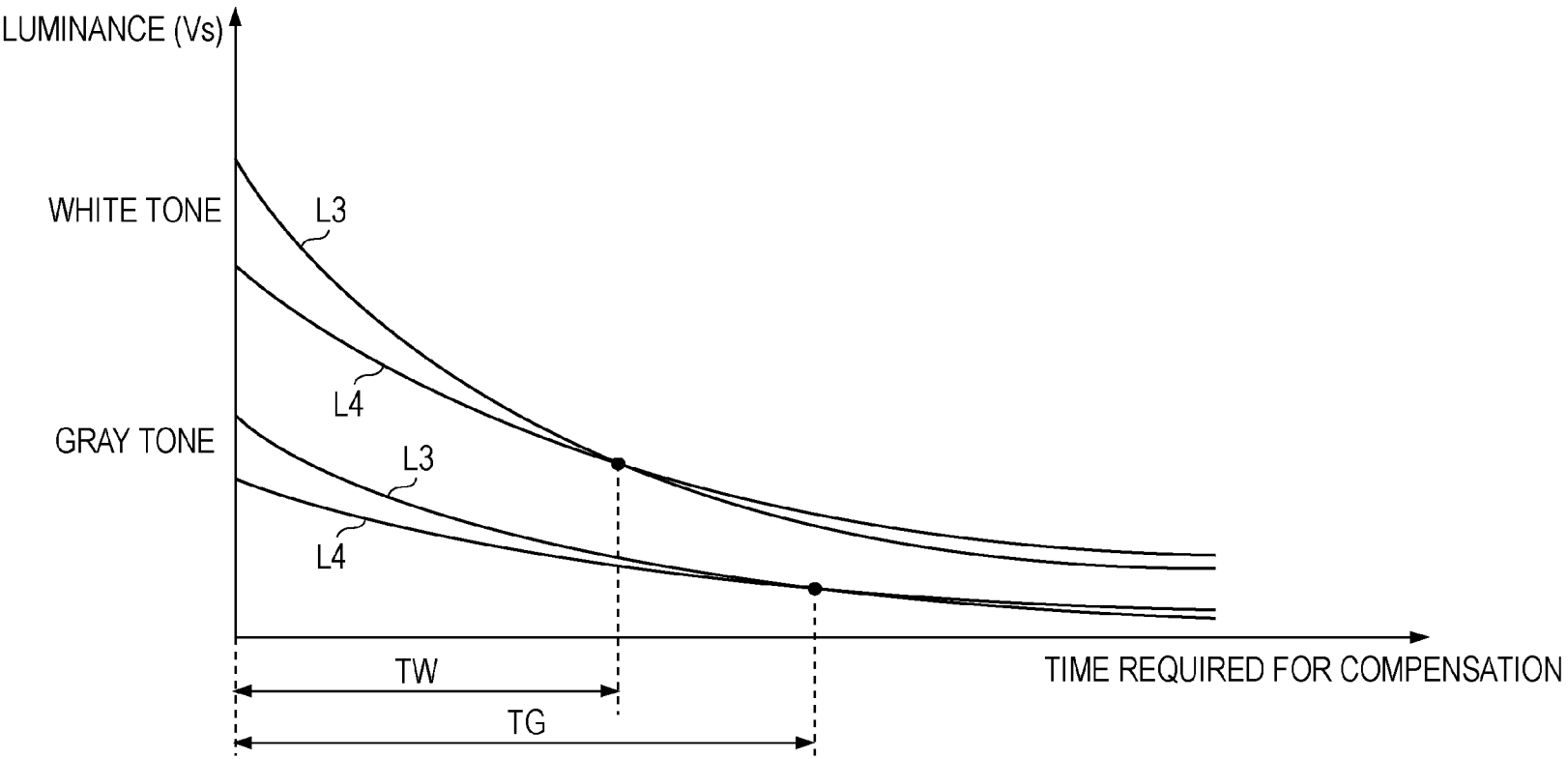
FIG. 7 is a plot of a characteristic curve for explaining over- and under-compensation for mobility fluctuations.
Figure 8:
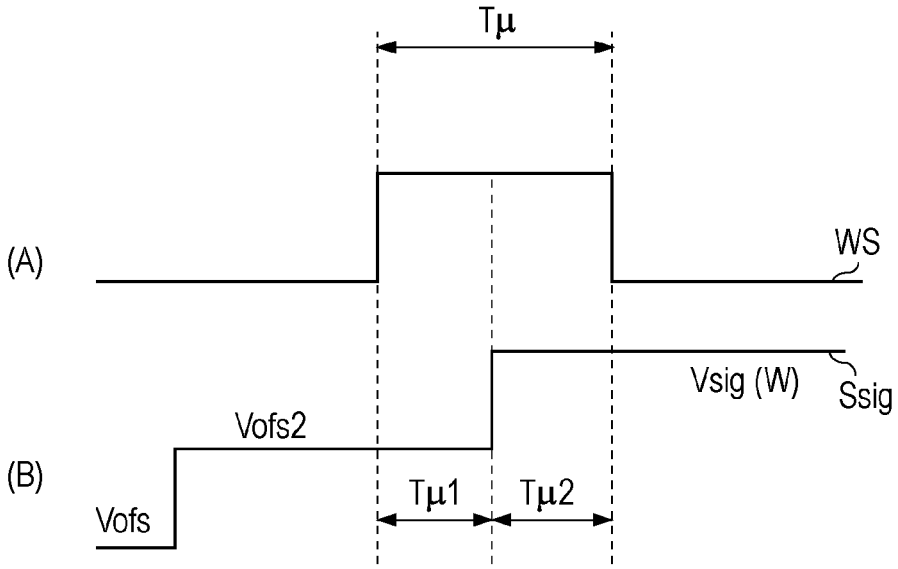
FIG. 8 is a timing chart illustrating signal waveforms in the case where a white tone is displayed when compensating for mobility fluctuations via an intermediate voltage.
Figure 9:
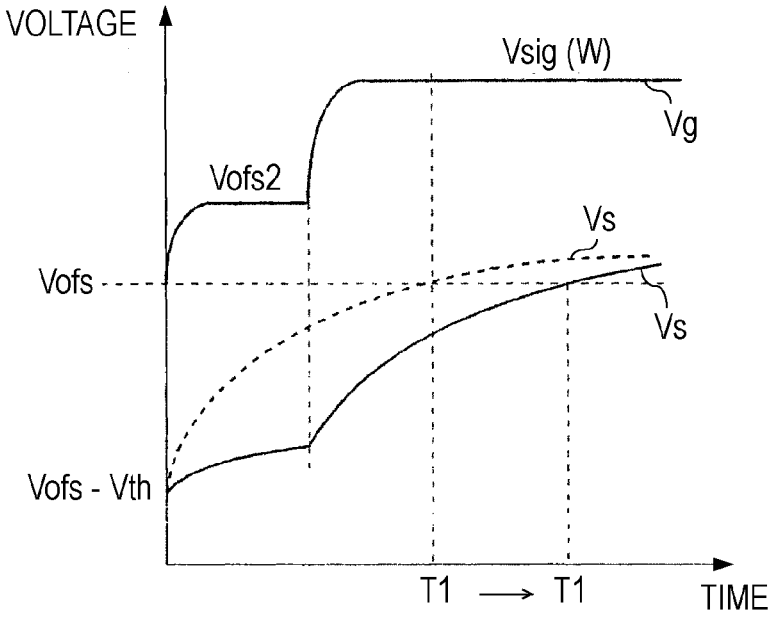
FIG. 9 is a timing chart for explaining the compensation for mobility fluctuations in FIG. 8.
Figure 10:
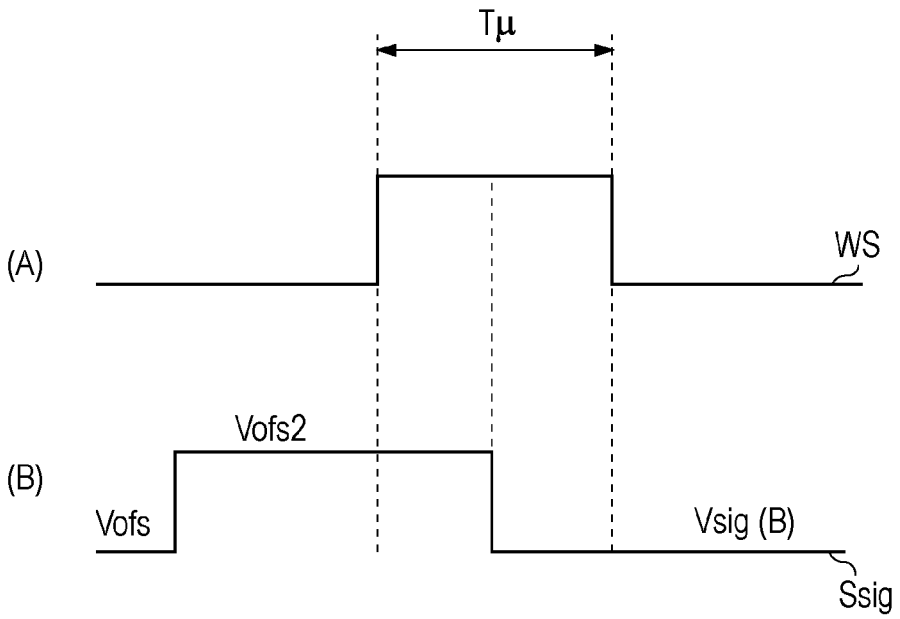
FIG. 10 is a timing chart illustrating signal waveforms in the case where a black tone is displayed when compensating for mobility fluctuations via an intermediate voltage.
Figure 11:
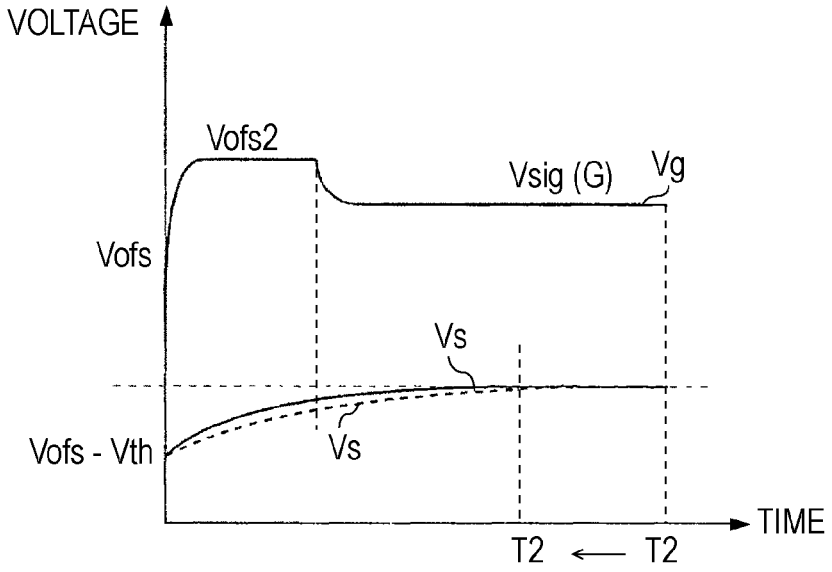
FIG. 11 is a timing chart for explaining the case wherein a gray tone is displayed when compensating for mobility fluctuations via an intermediate voltage.

Subsequently, after compensating for mobility fluctuations in the transistor TR2, the tone voltage of the signal line SIG is held at the signal level hold capacitor, and the luminance of the OEL element 4 is set (cf. FIG. 6).

At this point, if mobility fluctuations are compensated for by only the tone voltage Vsig, the time required to compensate mobility fluctuations will decrease for high luminance levels and increase for low luminance levels. As a result, the mobility fluctuations will be over- or under-compensated for according to the luminance, thereby leading to reduced image quality (cf. FIG. 7).

For this reason, the present embodiment performs the following. First, mobility fluctuations are compensated for using a given intermediate voltage Vofs2, and subsequently compensated for again using the tone voltage Vsig in accordance with the final voltage setting (cf. FIG. 3 and FIGS. 8 to 11). More specifically, by first compensating for the mobility using the intermediate voltage Vofs2, the time required to compensate for the mobility can be increased so as to be higher than that in the case wherein mobility fluctuations are compensated for by only the tone voltage Vsig, the time being increased when the tone voltage Vsig is higher than the intermediate voltage Vofs2. Likewise, the time required to compensate for the mobility can be decreased so as to be lower than that in the case wherein mobility fluctuations are compensated for by only the tone voltage Vsig, the time being decreased when the tone voltage Vsig is lower than the intermediate voltage Vofs2.

By varying the time required for mobility compensation in the display device 11, intermediate data D2 is generated by the intermediate data generator circuit 23 in accordance with image data D1, the intermediate data D2 being the source for the generation of the intermediate voltage Vofs2 (cf. FIG. 2). In so doing, a suitable intermediate voltage Vofs2 is set according to the tone voltage Vsig. Thus, even in the case where mobility fluctuations are compensated for over a fixed time T1, over- and under-compensation of mobility fluctuations depending on the luminance is prevented, and thereby reduced image quality is prevented.

More specifically, in the present embodiment, by configuring the intermediate voltage Vofs2 to vary with respect to the tone voltage Vsig in a manner expressible as a second-order function (cf. FIG. 4), fluctuations in the mobility of the transistor TR2 are compensated for without over- or under-compensation, even in the case where the luminance values have a variety of differing values. As a result, a high-quality displayed image is obtained.

Figure 12:
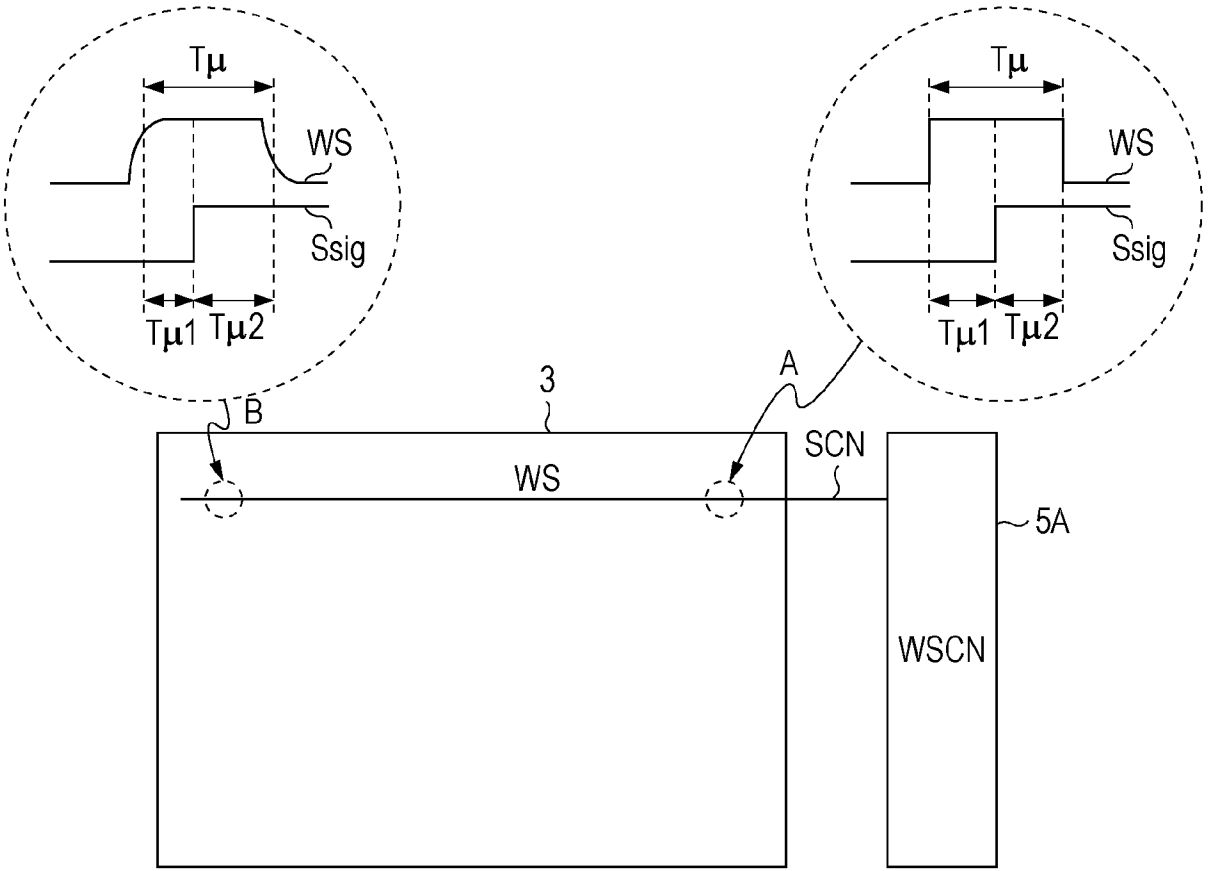
FIG. 12 is an abbreviated diagram of a circuit for explaining irregularities in the waveform of the write signal.

However, even when compensating for mobility fluctuations by using the intermediate voltage Vofs2 and the tone voltage Vsig in this way, there may occur irregularities in the waveform of the write signal WS that determines the period during which mobility fluctuations are compensated for. Such waveform irregularities cause the periods of compensation for mobility fluctuations to change among the respective components of the display unit 12, resulting in shading (cf. FIG. 12).

Consequently, the intermediate voltage Vofs2 in the display device 11 is also varied according to the distance from the input terminal of the write signal WS in the display unit 12 to a respective pixel 3 (cf. FIG. 1). In so doing, under-compensation of the mobility due to waveform irregularities is compensated for by the intermediate voltage Vofs2, even when such waveform irregularities exist in the write signal WS due to the distance from the input terminal of the write signal WS. As a result, fluctuations in the mobility of the drive transistor are suitably compensated for, and shading due to irregularities in the waveform of the write signal is prevented.

More specifically, in the present embodiment, by varying the intermediate voltage Vofs2 such that the peak value of the second-order function in accordance with the characteristic curve of the intermediate voltage Vofs2 increases with the distance from the input terminal, shading due to irregularities in the waveform of the write signal is prevented.

(3) Advantages of the Embodiment

According to the above configuration, mobility fluctuations in the drive transistor are compensated for by successively setting the voltage of the signal line to an intermediate voltage and to a tone voltage. Additionally, this intermediate voltage is varied both in accordance with the distance from the input terminal of the write signal to a respective pixel as well as in accordance with the tone voltage. In so doing, mobility fluctuations in the drive transistor are suitably compensated for, and shading due to irregularities in the waveform of the write signal is prevented.

In addition, after setting the signal level hold capacitor to the threshold voltage of the drive transistor, mobility compensation treatment is subsequently conducted wherein the intermediate voltage is varied with respect to the tone voltage, such that the change in the intermediate voltage with respect to the change in the tone voltage is expressible as a second-order function. In so doing, mobility fluctuations in the drive transistor are suitably compensated for, and shading due to irregularities in the waveform of the write signal is prevented.

In addition, the intermediate voltage is varied in accordance with the tone voltage such that the peak value of this second-order function increases as the distance from the input terminal increases. This has the concrete effect of suitably compensating for mobility fluctuations in the drive transistor and preventing shading due to irregularities in the waveform of the write signal.

Embodiment 2

In the foregoing embodiment, the case was described wherein the intermediate data is generated in a circuit external to the horizontal selector, and the intermediate voltage is generated by performing analog to digital conversion on this intermediate data at the horizontal selector. However, the present invention is not limited thereto, and a variety of techniques may be broadly applied as the method for generating the intermediate data. For example, the intermediate voltage may be generated by amplifying the non-linear characteristics of the tone voltage.

In addition, in the foregoing embodiment the case was described wherein the intermediate voltage is generated according to the characteristic curve of a second-order function. However, the present invention is not limited thereto, and advantages similar to those of the foregoing embodiment may be obtained by generating the intermediate voltage using a variety of characteristic curves with respect to the voltage set in the signal level hold capacitor before setting the intermediate voltage.

In addition, in the foregoing embodiment the case was described wherein the write signal is input from only one side of the display unit. However, the invention is not limited thereto, and configurations wherein the write signal is input from both sides of the display unit may be broadly applied.

In addition, in the foregoing embodiment the case was described wherein the light-emitting elements use OEL elements. However, the invention is not limited thereto, and configurations wherein various current-driven, light-emitting elements are used may be broadly applied.

It should be understood by those skilled in the art that various modifications, combinations, sub-combinations and alterations may occur depending on design requirements and other factors insofar as they are within the scope of the appended claims or the equivalents thereof.

What is claimed is:

1. A display device that displays a desired image, comprising:

a display unit, by which the desired image is displayed, the display unit being formed by disposing a plurality of pixels in a matrix formation, and the image being formed by driving each pixel using a horizontal drive circuit and a vertical drive circuit via a signal line and a scan line provided in the display unit;

wherein each pixel includes a light-emitting element, a signal level hold capacitor for retaining the signal level, a write transistor that connects one terminal of the signal level hold capacitor to the signal line, being switched on by a write signal output from the vertical drive circuit, and a drive transistor that drives the light-emitting element using a driving current in accordance with the voltage between the terminals of the signal level hold capacitor;

wherein during a non-emitting period in which the emission of light from the light-emitting element is suspended, the horizontal drive circuit switches the voltage of the signal line successively from a fixed voltage, to an intermediate voltage, and to a tone voltage that corresponds to the luminance of the light-emitting element, and the vertical drive circuit controls the write signal as well as the power source of the drive transistor to set the differential voltage between the terminals of the signal level hold capacitor to a pre-mobility compensation voltage, this voltage being the threshold voltage of the drive transistor;

wherein during a period that is subsequent to the horizontal drive circuit switching the voltage of the signal line from the fixed voltage, to the intermediate voltage, and to the tone voltage, the voltage of the signal line is again set to the intermediate voltage and the tone voltage, and the vertical drive circuit controls the write signal to compensate for a mobility of the drive transistor and set the differential voltage between the terminals of the signal level hold capacitor to a voltage corresponding to the tone voltage; and wherein the vertical drive circuit is connected to the scanning line at an input terminal thereof, the horizontal drive circuit is configured to, for each of the plurality of pixels in each frame period, variably select a value of the intermediate voltage based on at least:

the tone voltage to be input to the respective pixel in the respective frame period; and a distance from the input terminal of the scanning line to the respective pixel, such that the values of the intermediate voltage are expressible by a second-order function, wherein varying the intermediate voltage in accordance with changes in the tone voltage includes:

increasing the time required to compensate for the mobility when the tone voltage is higher than the intermediate voltage, and decreasing time required to compensate for the mobility when the tone voltage is lower than the intermediate voltage.

2. The display device according to claim 1, wherein the horizontal drive circuit variably selects the value of the intermediate voltage by referring to a characteristic curve having the tone voltage as an independent variable, where a peak value of the characteristic curve varies as the distance varies such that the peak value of the characteristic curve increases as the distance increases.

3. A method for driving a display device that displays a desired image using a display unit, the display unit being formed by disposing a plurality of pixels in a matrix formation, and the image being formed by driving each pixel via a signal line and a scan line provided in the display unit, each pixel including a light-emitting element, a signal level hold capacitor for retaining the signal level, a write transistor that connects one terminal of the signal level hold capacitor to the signal line, being switched on by a write signal output via the signal line, and a drive transistor that drives the light-emitting element using a driving current in accordance with the voltage between the terminals of the signal level hold capacitor, the method comprising the steps of:

during a non-emitting period in which the emission of light from the light-emitting element is suspended, switching the voltage of the signal line successively from a fixed voltage, to an intermediate voltage, and to a tone voltage that corresponds to the luminance of the light-emitting element;

controlling the write signal as well as the power source of the drive transistor to set the differential voltage between the terminals of the signal level hold capacitor to a pre-mobility compensation voltage, this voltage being the threshold voltage of the drive transistor;

during a period that is subsequent to the horizontal drive circuit switching the voltage of the signal line from the fixed voltage, to the intermediate voltage, and to the tone voltage, the voltage of the signal line is again set to the intermediate voltage and the tone voltage, and controlling the write signal to compensate for a mobility of the drive transistor and setting the differential voltage between the terminals of the signal level hold capacitor to a voltage corresponding to the tone voltage; and for each of the plurality of pixels in each frame period, variably selecting a value of the intermediate voltage based on at least:

the tone voltage to be input to the respective pixel in the respective frame period; and a distance from a location at which the write signal is applied to the signal line to the respective pixel, such that the values of the intermediate voltage are expressible by a second-order function, wherein varying the intermediate voltage in accordance with changes in the tone voltage includes:

increasing the time required to compensate for the mobility when the tone voltage is higher than the intermediate voltage, and decreasing time required to compensate for the mobility when the tone voltage is lower than the intermediate voltage.

* * * * *